United States Patent [19]

Kahmann

[11] 4,061,283

[45] Dec. 6, 1977

[54] REFINER FOR GRINDING OF FIBROUS MATERIAL

[75] Inventor: Albrecht Kahmann, Weingarten, Germany

[73] Assignee: Escher Wyss GmbH, Weingarten, Germany

[21] Appl. No.: 693,918

[22] Filed: June 8, 1976

[30] Foreign Application Priority Data

June 11, 1975 Switzerland ..... 7533/75

[51] Int. Cl.[2] ..... B02C 7/12

[52] U.S. Cl. ..... 241/261.3; 241/197; 241/296

[58] Field of Search ..... 241/197, 261.2, 261.3, 241/296, 297, 298, 291, 300

[56] References Cited

U.S. PATENT DOCUMENTS

| | | | |
|---|---|---|---|
| 3,160,355 | 12/1964 | Chiaverina | 241/291 |
| 3,462,089 | 8/1969 | Whitlow | 241/296 |
| 3,561,686 | 2/1971 | Hedrick | 241/197 |

*Primary Examiner*—Granville Y. Custer, Jr.
*Attorney, Agent, or Firm*—Kenyon & Kenyon, Reilly, Carr & Chapin

[57] ABSTRACT

The teeth of the stator and rotor of the refiner are each formed with a surface layer on the leading flanks which is harder than the end faces so as to maintain a sharp cutting edge. The hardness of the surface layer is at least 600 HB while the end face is of a hardness of from 280 to 320 HB.

2 Claims, 2 Drawing Figures

REFINER FOR GRINDING OF FIBROUS MATERIAL

This invention relates to a refiner for grinding of fibrous material and, more particularly, to the teeth of the stator and rotor of a refiner.

As is known, refiners for the grinding of fibrous materials, particularly in the paper making industry, employ a toothed stator and a toothed rotor which can move relative to the stator. Generally, in order to prepare pulp for processing in a paper making machine, the refiner must be capable of grinding the fibrous material, for instance cellulose, to a required degree. To this end, the teeth of the stator and rotor have been rib-shaped with substantially rectangular cross-sections in order to present sharp cutting edges. However, during operation, these sharp edges become rounded and blunted. As a result, considerable energy losses occur since a refiner with blunt-edged teeth requires substantially more energy to achieve a required degree of grinding than a refiner with sharp-edged teeth.

Accordingly, it is an object of the invention to provide a refiner with teeth which retain sharp cutting edges over prolonged periods of use.

It is another object of the invention to reduce the energy requirements of a refiner.

Briefly, the invention provides a refiner for grinding fibrous material comprising a stator having a plurality of teeth of substantially rectangular cross-section and a rotor having a plurality of rib-shaped teeth of substantially rectangular cross-section and disposed in facing relation to the stator wherein each tooth of the stator and rotor has a leading flank disposed in the mutual direction of movement, an end face and a surface layer on the leading flank of a hardness greater than the hardness of the end face. With the teeth flanks constructed in this manner, the front edges of the end faces of the teeth wear away more slowly than the end faces themselves. The result is that a front sharp edge which is favorable to the grinding process always remains during the course of wear.

Preferably, the hardness of the surface layer at the flanks can be greater than 600 HB, with a hardness of the material at the end faces of 280 to 320 HB. A hardness of this kind can be achieved, for instance, by known diffusion processes, such as carburizing, boriding, vanadizing, toraxizing and nitriding. However, the surface layer can also be produced by the application of hard materials, for instance, by plasma spraying.

Figure 1:
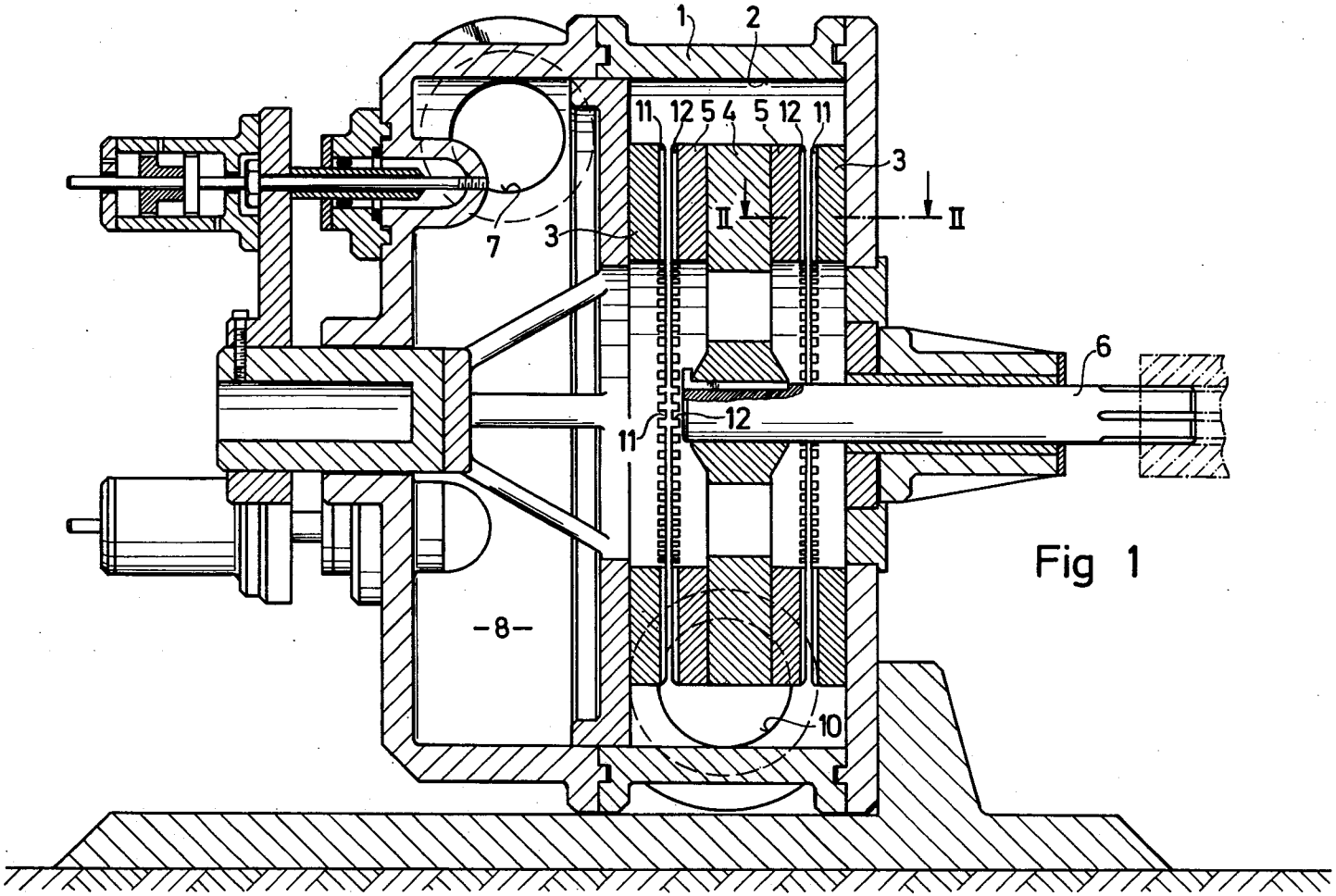
Figure 2:
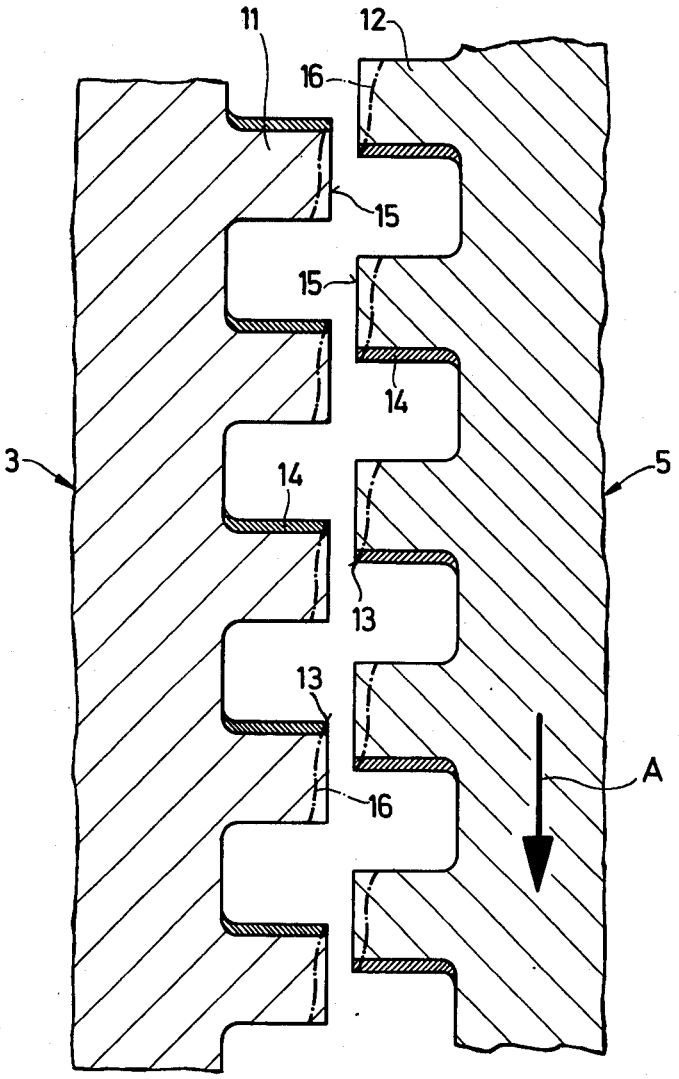

These and other objects and advantages of the invention will become more apparent from the following detailed description and appended claims taken in conjunction with the accompanying drawings in which:

FIG. 1 illustrates an axial sectional view through a disc-type refiner to which the invention can be applied, and FIG. 2 illustrates a partial sectional view taken along line II—II in FIG. 1.

Referring to FIG. 1, the disc-type refiner, such as that disclosed, for instance, in Austrian Patent Specification No. 319,729 (U.S. Pat. No. 3,810,584), comprises a casing 1 having a grinding chamber 2 receiving two immobile, annular stators with stator linings 3 and a rotor 4 with rotor linings 5 with each rotor lining 5 facing a stator lining 3. The rotor 4 is driven via a shaft 6 by a drive motor (not shown).

Fibrous material to be ground is fed to the refiner via an inlet line 7 which opens into an inlet chamber 8. From the inlet chamber 8, the fibrous material flows in the form of a suspension into the grinding chamber 2 and then passes out through an outlet line 10. During this flow, the fibrous material moves between the linings 3, 5 and is ground by teeth with which the linings 3, 5 are formed.

Referring to FIG. 2, the grinding linings 3, 5 are annular members having rib-like teeth 11, 12 which do not extend radially in the linings 3, 5, but at an inclination, to avoid causing excessive noise. As can be gathered from FIG. 2, when new, the teeth 11, 12 are of substantially rectangular cross-section and have sharp cutting edges 13. The leading flank of each tooth 11, 12, that is, the flank disposed in the mutual direction of movement (as indicated by the arrow A) between the rotor linings 5 and stator linings 3, is provided with a surface layer 14 of hard material to avoid blunting of the cutting edge 13, and thus, maintain a sharp cutting edge during operation. To this end, the surface layer 14 is of a hardness greater than the hardness of the end face 15 of the tooth 11, 12.

During operation, due to the hardness of the surface layers 14, the teeth 11, 12 wear away more slowly in the zone of the cutting edges 13 than in the end faces 15 which are disposed behind the cutting edges 13. Thus, during operation, wear mainly follows a course shown by the dot-dash lines 16 (FIG. 2); the ends of the hard layers 14 projecting due to their greater hardness and maintaining the cutting edges 13.

The hard surface layers 14 can be produced in known manner by a diffusion process or by the application of some hard material. For instance, they can be produced by carburization, boriding, vanadizing, toraxizing or nitriding. Application can be, for instance, by the plasma spraying of a hard material, such as chromium oxide, tungsten or some hard metal.

In order to achieve the purpose of the invention, the end face 15 of a tooth 11, 12 must be softer than the surface layer 14 of the flank of a tooth 11, 12. Thus, if the end faces 15 of the teeth cannot successfully be kept softer during formation of the surface layers 14, the end faces 15 must be reground.

Basically, the hard surface layers 14 can be formed on both flanks of the teeth, both the leading and trailing flanks. In that case, the result is a trough-like wearing of the end faces 15 of the teeth during use. However, the teeth as illustrated in FIG. 2 are preferred.

Although the invention has been described in relation to a disc refiner, it can of course also be used with other refiners having rib-shaped teeth, such as, for instance, cone-type refiners. Further, the cross-section of the teeth need not be precisely rectangular. For example, the teeth can also have slightly inclined flanks.

What is claimed is:

1. A refiner for grinding fibrous materials comprising
   a stator having a plurality of rib-shaped teeth of substantially rectangular cross-section; and
   a rotor having a plurality of rib-shaped teeth of substantially rectangular cross-section, said rotor being disposed in facing relation to said stator;
   each said tooth of said stator and said rotor having a leading flank disposed in the mutual direction of movement of said stator and rotor, an end face and a surface layer on said leading flank of a hardness greater than the hardness of said end face to maintain a sharp cutting edge during operation.

2. A refiner as set forth in claim 1 wherein said surface layer has a hardness higher than 600 HB and said end face has a hardness between 280 to 320 HB.

* * * * *